United States Patent [19]

Harrington

[11] 4,204,357

[45] May 27, 1980

[54] FLYING DISC

[76] Inventor: Richard H. Harrington, 313 N. Seventh St., Ann Arbor, Mich. 48103

[21] Appl. No.: 808,593

[22] Filed: Jun. 21, 1977

[51] Int. Cl.[2] ..... A63H 27/00

[52] U.S. Cl. ..... 46/74 D; 213/424

[58] Field of Search ..... 46/74 D, 220; 273/106 B

[56] References Cited

U.S. PATENT DOCUMENTS

| | | | |
|---|---|---|---|
| 2,985,985 | 5/1961 | Le Brooy et al. | 46/220 |
| 3,359,678 | 12/1967 | Headrick | 46/74 D |
| 3,828,466 | 8/1974 | Geiger | 273/106 B |
| 3,852,910 | 12/1974 | Everett | 46/74 D |
| 3,939,602 | 2/1976 | Burke et al. | 46/74 D |

*Primary Examiner*—Louis G. Mancene
*Assistant Examiner*—Paul J. Hirsch
*Attorney, Agent, or Firm*—Donald P. Gillette

[57] ABSTRACT

A molded flying disc with most of the weight concentrated in an outer annular ring. The central opening in the ring is covered by a thin sheet of material, such as plastic or cloth, stronger than a sheet of the molded material of the same thickness and diameter. The perimeter of the sheet is attached to the ring.

42 Claims, 14 Drawing Figures

FLYING DISC

BACKGROUND OF THE INVENTION

1. Field of the Invention

This invention relates to flying discs and particularly to toy discs thrown by hand in such a way as to have both forward and angular momentum.

2. The Prior Art

The type of toy with which this invention is concerned is similar to discs marketed under the trademark Frisbee by Wham-O Manufacturing Co. Such a toy has a relatively flat, circular central plate with an outer rim curved away from the plate to form a shallow dish. The edge of the rim has a rounded cross section resembling an air foil. The thickest part of the air foil is not immediately adjacent the edge but is perhaps one-third or so of the distance from the edge to the plate. The inwardly facing surface of the air foil section is substantially flat in cross section and, therefore, defines a generally cylindrical surface. The entire disc is molded of a suitable thermoplastic material, such as polyethylene, and the cylindrical configuration of the inwardly facing surface of the rim makes it easy to remove the disc from the mold.

While the central section has been referred to as a plate, it need not be perfectly flat, although it may be. Frequently this section is molded to have a slightly convex curvature as viewed from the side away from the rim. However, the central surface is so nearly planar that, for descriptive simplicity, it will be referred to as planar hereinafter.

Interest in the type of discs with which this invention is concerned is based on their flight characteristics. The shape of the disc gives it lift, when properly thrown, so that it does not simply sink to the ground as would a smooth, spherical ball of the same mass thrown with the same force. Some enthusiasts try to throw such a disc so that it flies as far as possible, and contests are held for that purpose. Other enthusiasts like to throw a flying disc of the shallow dish type back and forth to each other, either keeping the discs in the air or bouncing it off the ground somewhere between the players. Still other players try to cause their discs follow unusual, curved flight paths.

As might be expected, the various requirements of different players have led to different designs of Frisbee discs, the only brand of flying discs seriously considered by expert players. A main difference is in the weight, which may be as light as about 110 grams or as heavy as about 180 grams. Wind conditions have an important bearing on the particular discs that an enthusiast will select at a given time. Heavier ones are usually preferred in windy weather.

Although polyethylene does not shatter as would a more brittle material, it can be nicked, particularly when it is bounced off a paved surface or flies into an abrasive surface. The resulting projections from the originally smooth surface can make the disc painful to catch.

The flight characteristics of a flying disc are affected by the air foil and surface configuration, especially on the convex surface. Such discs are normally thrown with the rim extending downwardly from the plate, which is equivalent to saying that the convex surfaces face upwardly. For this reason the convex surfaces will be referred to as the upper ones and the concave surfaces as the lower ones in the following description.

There is a Right Hand Rule of Spinning Objects that is important in determining the flight path that will be followed by a spinning disc. It has been found desirable to mold slightly raised, concentrically circular ridges in the upper surface of a flying disc near the outer part thereof to reduce air drag and improve precessional qualities of the disc by counteracting the force produced by the Right Hand Rule just mentioned. U.S. Pat. No. 3,359,678 to Headrick describes such ridges, which interfere with air flow and therefore are called "spoilers". It is thought that such concentric ring spoilers have the greatest effect when the forward velocity of flying discs in scientific terms disc is greatest relative to the wind speed. Thus, the concentric ring spoilers are effective in flights for distance but are apparently not so much so in shorter flights.

Other publications that describe characteristics of Frisbees are the book *FRISBEE* by Stancil E. D. Johnson, M.D. published by Workman Publishing Company, New York, and a paper entitled "Adaptation of the Frisbee Flight Principle to Delivery of Special Ordinance" by G. D. Stilley of Honeywell Incorporated and D. L. Carstens of the Naval Ammunition Depot, Crane, Indiana, and presented at the AIAA 2nd Atmospheric Flight Mechanics Conference at Palo Alto, California, Sept. 11–13, 1972 (AIAA Paper No. 72-982).

OBJECTS AND SUMMARY OF THE INVENTION

It is one of the objects of this invention to provide a flying disc with improved flight characteristics.

Another object is to provide a flying disc with improved structural features.

Still another object is to provide a disc with snapattachment means to adjust the flight characteristics.

Another object is to provide a disc with improved spoilers that operate at low forward velocity of the disc.

A further object is to provide a disc with improved air foil.

A still further object is to provide a disc of improved strength to weight ratio.

A still further object is to increase the angular momentum of a flyable toy disc.

Yet another object is to provide a disc suitable for printing art work by photographic techniques.

A still further object is to provide a disc on which individual art work can be printed photographically.

Other objects will become apparent from the following detailed description and claims and the associated drawings.

DETAILED DESCRIPTION OF THE INVENTION

Figure 1:
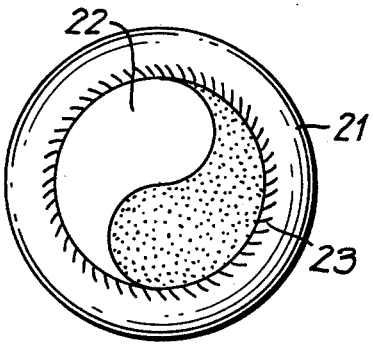
FIG. 1 is a top view of a disc according to this invention.

FIG. 1 is a top view of a decorated disc comprising an annular member 21 and a circular central sheet, or web, 22 the perimeter of which is joined to the radially inner part of the member 21. The top surface of the annular member 21 has a circular array of spoilers 23, which are illustrated in this figure as a series of raised, narrow ridges each of which extends in a substantially radial direction. Several embodiments of suitable spoilers will be described farther on in this description.

The central openings in the annular member 21 is covered by a disc of strong, lightweight material, such as Mylar or Estar brand film (a trademark of Eastmen Kodak Co.), or similar polyester film that has a good strength-to-weight ratio, or a film of other suitable materials, such as acrylic material or polycarbonate materials, or a laminate of polyethylene and polyester, or even cloth, such as denim. Mylar and other plastic films need only be of the order of about 0.007" to about 0.011" thick, which is thinner than even the thinnest polyethylene web that can be satisfactorily molded integrally with the annular outer section.

The use of a lightweight, but strong, central web 22 has, as two of its most important advantages, substantially greater tear strength and lighter weight than a thin, integrally molded polyethylene web, which means that for a polyethylene molded annular member 21 of exactly the same configuration, the two-part disc (annular member and web) will stand up under greater abuse than an integrally molded, one-part disc. The greater concentration of weight in the outer annular member, or ring, results in increased angular momentum which, in turn, results in greater stability and flights of longer duration and distance for a given impetus. A Mylar web 22 with a thickness of only 0.007" using 0.003" laminating material weighs approximately 12 grams and can replace an integrally molded central web portion weighing about 50 grams in existing discs, thus resulting in a weight reduction of about 24%. Since the reduced weight is in the central region and not in the outer ring, the weight of the latter automatically is a greater percentage of the smaller total weight, which yields longer flight times, slower velocity, and slower drop rate. This allows two players throwing such a disc back and forth to each other more time to catch it. Furthermore, the Mylar or other plastic web is very smooth, which reduces drag and results in flights of still greater distance.

Tests made to determine the puncture strength of Mylar webs attached tautly across the opening formed by removing the integrally molded central polyethylene web of a Wham-O SuperPro Frisbee disc and to compare the strength so measured with the strength of the 0.079" thick integrally molded central web of mold 60 SuperPro Frisbee discs were carried out. The round, or shank, end of a 0.089" drill bit was cut off perpendicular to its axis and the intersection of the cut-off end and the cylindrical side was left sharp and not beveled. The bit was placed in a drill press vice with the squared-off end facing upwardly, and the vice was placed on a bathroom scale. The zero adjustment knob of the scale was turned to bring the scale pointer to zero, and the integrally molded web of a 0.079" thick mold 60 SuperPro Frisbee disc was forced down on the drill bit until the web ruptured. The scale reading just before rupture was noted, and the same experiment was performed on five such Frisbee discs. The average of the five scale readings thus obtained was 19.4 pounds.

The same set-up was then used to rupture 0.007" thick laminated circular Mylar webs the peripheries of which had been attached tautly to the inner perimeter of SuperPro rings. Six such Mylar webs were ruptured and the average rupture pressure was 25 pounds, which is 26% higher than the rupture pressure of the polyethylene, even though the Mylar was much thinner.

A similar set of experiments was performed using a blunt presser, the 0.116" diameter relatively spherically rounded end of a miniature toggle switch lever. In this set of experiments five Frisbee discs of a type having an integrally molded polyethylene web thickness of 0.074" were used, and the average rupture pressure was 32.6 pounds. The average of six readings of the same type of Mylar subjected to the same presser was 50.67 pounds, which indicated the Mylar was 54% stronger than the much thicker polyethylene in withstanding pressure from a blunt instrument.

Still another advantage of Mylar is that it is a suitable photographic base on which to reproduce artistic designs or personal photographs or commercial messages. FIG. 1 shows a simple design, the yin and yang of Chinese antiquity, but this is only a simple illustration. Personal photographs can be printed on a Mylar web or the like, such as Kodak Extacolor I.D. Print Material 4023 with a white back Ester base, to provide incontrovertible proof of ownership in case the disc is commingled with other discs on a beach or other public play area. Designs on the plastic or cloth webs can also be printed by silk screening, and cloth webs can be embroidered.

One surface of the Mylar can also (or can alternatively) be given a reflective coating to serve as a signalling mirror or even a solar stove by covering the concave side of the disc with a rubber membrane that closes the space airtight and then pulling the central part of the membrane to create a spherically concave despression in the Mylar to concentrate reflected sunlight. Another alternative is to leave the Mylar or other plastic web transparent but form one or both of its surfaces into a Fresnel lens to concentrate the sun's rays.

Figure 2:
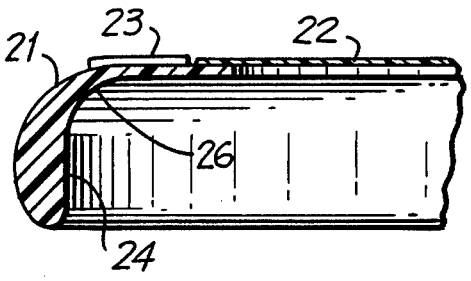
FIG. 2 is a cross-sectional view of a fragment of a disc of the type in FIG. 1.

FIG. 2 shows part of the annular ring 21 in cross section. In this embodiment the perimeter of web 22 is glued to the upper surface of the inner perimeter of the ring 21 and the radially inner ends of the spoilers 23 terminate at the periphery of the web. The adhesive may be neoprene with 1, 1, 1-trichloroethane as a thinner. The part of the surface of the ring to which the web is to adhere is oxidized, either chemically or by being directly heated with a flame just long enough to make that part of the surface of the ring 21 slightly shiny. To apply the flame, the ring may be mounted on a turntable and rotated at about 20 to 100 r.p.m. for several seconds, time enough for the turntable to rotate from about two to twenty revolutions with propane gas flame playing on the surface to be oxidized. The oxidized inner annular part of the ring 21 is coated with the adhesive as is the part of the web 22 to be joined to the ring. The adhesive is allowed to dry for about 15 minutes to 3 hours on the web and the ring before they are brought into contact with each other. Then the adhesive-coated outermost annular part of the web 22 is pressed against the adhesive-coated innermost annular part of the ring 21 with a force of about 250 to 1000 lg./sq. in. pressure for about 10 seconds or longer. A pressure of 500 lb./sq. in. for 15 seconds has been found quite satisfactory. While one inner section 24 of the ring 21 is relatively straight in this cross-sectional view and, therefore, cylindrical, or even slightly tapered, in its full, three-dimensional form, a higher inner surface part 26 is distinctly curved to fit better on the tips of the fingers of a person throwing the disc.

Figure 3:
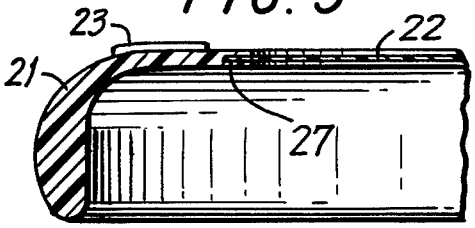
FIG. 3 is a cross-sectional view of a fragment of another embodiment of a disc similar to that in FIG. 1.

In FIG. 3 the web 22 is captured between the inner part 27 of the ring 21 and the under side 28 of the section of the ring beneath the spoilers 23. In fact, the spoilers 23 in this embodiment may, instead of being integrally molded with the ring, be individual strips of suitable material, such as a cloth-based tape, one surface of which is coated with pressure-sensitive adhesive that is capable of sticking to the material 22. As a further alternative, the peripheral region of the web 22 may be molded within the inwardly extending part of the ring 21 and not merely between the spoilers 23 and an unbroken annular region therebelow.

Figure 4:
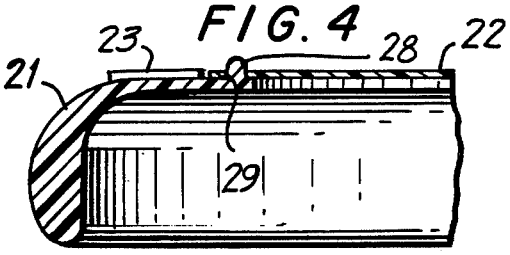
FIG. 4 is a cross-sectional view of still another embodiment of a disc similar to that in FIG. 1.

FIG. 4 shows an annular member 21 modified by having a plurality of projections 28 molded near its inner perimeter and extending substantially parallel to the axis of the annular member. The web 22 has plurality of holes 29 that fit over the projections 28. For adequate dispersion of stresses, there should be preferably about 50 pins 28 and holes 29.

Figure 5:
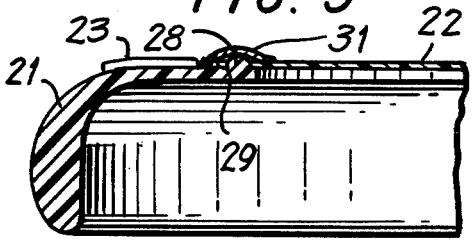
FIG. 5 is a cross-sectional view of the structure in FIG. 4 at a later stage of construction.

FIG. 5 shows the same structure as FIG. 4 but at a later step of manufacture after the pins 28 have been heated and flattened out. FIG. 5 also shows a cross-section of an annular ring 31 of paper having pressure-sensitive cement on its lower surface so that it can be sealed over the flattened pins.

The Mylar webs 22 attached to annular rings 21 as shown in FIGS. 1–5 are not only more resistant to rupture by either a rounded punch or a sharp-edged punch than are the integrally molded polyethylene webs but are more resistant to deflection. For example, a two-pound weight resting in the center of a Frisbee disc having a web thickness of about 0.055" causes a deflection of about 0.44". A laminated mylar web attached to the outer ring of the same type of Frisbee disc after the integrally molded web has been removed is deflected only about 0.16", which is about 36% of the deflection of the much thicker polyethylene web. It has been suggested that too thin a web (of the integrally molded type) is deflected too much in flight, which interfers with its flying characteristics. The much more rigid web of taut Mylar material avoids this disadvantage.

Figure 6:
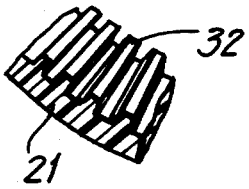
FIGS. 6–8 are enlarged perspective views of fragments of different embodiments of spoilers that can be used.
Figure 7:
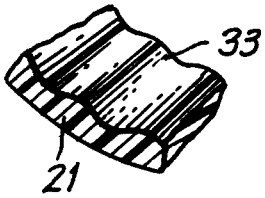
Figure 8:
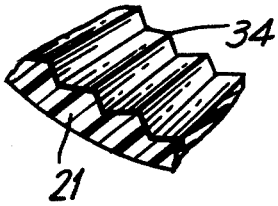

FIGS. 6–8 show radial spoilers that may be used instead of the spoilers 23 that extend partly in a radial direction and partly tangentially. The spoilers in FIGS. 6–8 are integrally molded on the upper surface of the annular member 21. In FIG. 6 the spoilers 32 have a rectangular cross section; in FIG. 7 the spoilers 33 have a rounded, and in fact, a sinusoidal, cross section; and in FIG. 8 the spoilers 34 have a triangular cross section. The spoilers should be balanced about the axis of the disc but they may or may not be uniformly angularly spaced apart. For example, the spoilers as shown in any of FIGS. 6–8 could be separated into three groups with those in the first group having one angular spacing, those in the second group having a second spacing, and those in the third group having a third spacing. The three spacings could be selected to set up sound vibrations of the proper relative frequencies to produce, for example, C, E, and G notes, resulting in a C major chord.

The radial spoilers also strengthen the ring 21 by acting as rip stops for any rip in the tangential direction and within the radial extent of the spoilers. The radial spoilers also reduce the tendency to follow a path that curls at the end of a flight, as some flying discs are wont to do.

Figure 9:
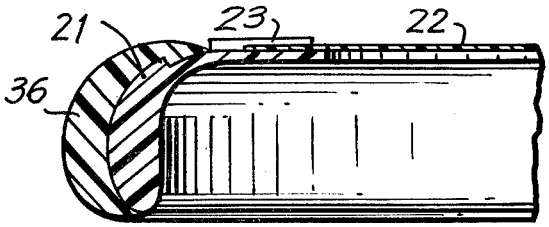
FIG. 9 is a cross-sectional view of a fragment of a disc with an external snap-on rim cover.
Figure 10:
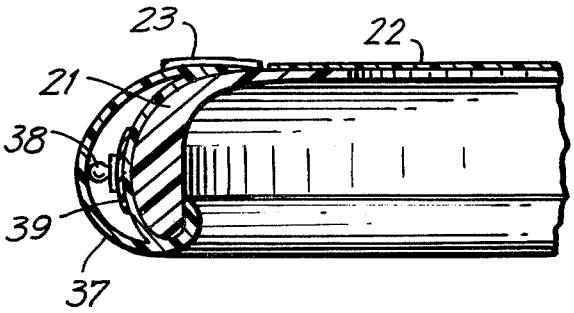
FIG. 10 is a cross-sectional view of a fragment of a disc with an illuminated snap-on ring.
Figure 11:
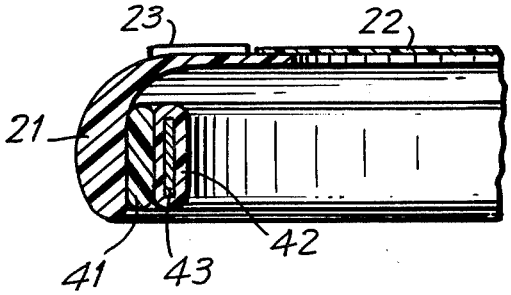
FIG. 11 is a cross-sectional view of a fragment of a disc with snap-in weighted rings.

FIGS. 9–11 show discs 21 with snap attachments. In FIG. 9 an external snap-on cover 36 fits over the down-turned rim of the ring 21 to protect it and to add weight at the periphery of the disc. The cover 36 also changes the curvature of the outer surface of the air foil. However, the original cross section of the ring 21 may be formed with a flatter air foil so that the snap-on cover provides only an ordinary amount of curvature. In addition, the cover 36 may be of uniform thickness throughout to avoid changing the air foil shape.

FIG. 10 also shows a snap-on external ring 37 that is generally hollow and contains one or more light-emitting diodes 38 and a printed circuit 39 to control the light of the L.E.D.'s to produce an interesting stroboscopic effect at night. Except for the electrical components, the ring 37 is hollow, which provides enough bouyancy to be certain that the disc will float if it falls into water.

FIG. 11 shows a disc with two snap-in rings 41 and 42 for extra weight. The rings may be graded in some specific ratio, such as 10 gram intervals. For example, the ring 41 may be representative of 10 gram, 20 gram, and 30 gram weights. The ring 42 is additionally weighted by a loop of steel 43 that is 0.25" wide and 0.010" to 0.020" thick. In fact the ring 21 may be molded of polyethylene. The snap-in rings are molded to have a tight interference fit with the down-turned rim of the ring 21. Also, the inner surfaces of the ring toe-in slightly. The toes-in angle is known as the Angle of Francioni.

Figure 12:
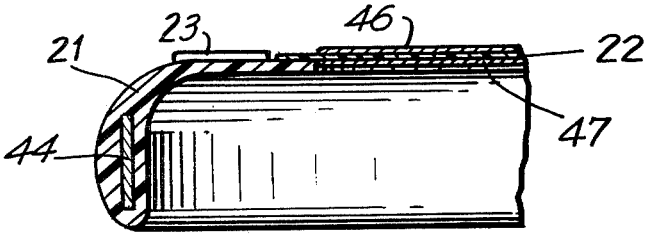
FIG. 12 is a cross-sectional view of a fragment of a disc with an internally weighted rim.

FIG. 12 shows a ring 21 with a steel band 44 molded into it to add weight. The total weight may be 200 grams.

The weighted rings 21 in FIGS. 11 and 12 are less inclined to remain deformed than are existing flying discs. If deformed in any direction, they spring back immediately into their proper shape, This minimizes wobbling during flight.

FIG. 12 also illustrates an arrangement for printing information photographically on the web 22. The web may be photosensitized Mylar material coated on both surfaces with sheets of opaque paper 46 and 47 attached by pressure-sensitive adhesive to the Mylar web. The top paper 46 layer is peeled off to allow the photosensitized Mylar web to be exposed to the desired image, and then the latent image is developed. The bottom paper 47 is preferably removed before the latent image in the Mylar web is developed.

Figure 13:
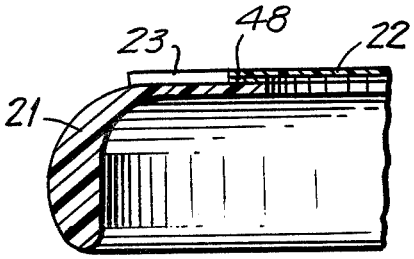
FIG. 13 is a cross-sectional view of a modified attachement means for joining a central web to an annular rim to form a flying disc.

FIG. 13 illustrates still another way to attach the web 22 to the ring 21. An annular ring 48 of paper is coated top and bottom with pressure-sensitive cement. It is then placed on the ring 21 to be affixed to the top surface of the ring 48.

Figure 14:
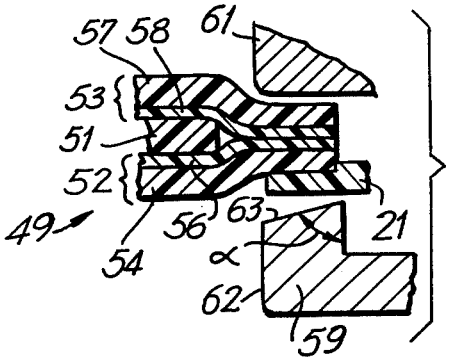
FIG. 14 is an enlarged cross-sectional view of a fragment of a disc ring and the edge of a laminated web, and means for joining them together.

FIG. 14 is an enlarged view of just the innermost part of the outer ring 21 similar to that in FIG. 1, for example but showing only the part to which the web is attached. The web, indicated by reference numeral 49, includes a central disc 51 of artwork, such as a photograph, print drawing, painting, etc. on any suitable material, such as a plastic photographic film base or even paper. The central disc 51 is entirely enclosed by two laminated discs 52 and 53 of somewhat larger diameter than the disc 51. The laminated disc 52 is a sheet of extruded polyester and polyethylene. The layer 54 of polyester is on the outside and is approximately 0.005" thick, while the layer 56 of polyethylene is approximately 0.002" thick and is on the inside in contact with the disc 51. The other extruded disc 53 has corresponding layers of 0.005" thick polyester 57 and 0.002" thick polyethylene 58, and an annular band of the edges of the polyethylene layers 56 and 58 are sealed together to encase the disc 51 snugly.

The annular peripheral region of the polyester layer 54 is sealed adhesively to the inner annular perimeter of the upper surface of the ring 21 by coating with neoprene plus 1, 1, 1-trichloroethane the surfaces to be joined. The procedure has been described previously and need not be repeated. FIG. 14 also shows two members 59 and 61 to apply pressure to join the disc 49 to the ring 21. The member 59 is a disc of steel or other suitable material capable of withstanding high pressure and has an up-turned rim 62 with a frusto-conical upper surface 63 having an included angle $\alpha$ of between 150° and 180°. The outer peripheral region of the layer 54 and the inner peripheral region of the ring 21 are pressed together by the members 59 and 61. The frusto-conical shape of the surface 63 helps to stretch the disc 49 taut so that it will remain that way after the pressure is removed.

While this invention has been described in terms of specific embodiments, those skilled in the art will be aware of further modifications that can be made within the true scope of the invention.

What is claimed is:

1. A flying disc comprising:

an annular member defining an open inner area and comprising an air-foil shaped cross-section defined by different curvature on opposite surfaces and having a thickness that depends on the radial point at which the thickness is measured; and a thin sheet of a different material having a lighter weight for a volume bounded by an area of unit size and by the thickness of said sheet at said area than the average weight of a volume of said annular member bounded by an area of said unit size and by the thickness of said annular member at the thickest point thereof, said sheet having an outer perimeter affixed to said annular member to cover said open inner area.

2. The disc in claim 1 comprising means to hold said thin sheet tautly in position covering said open inner area.

3. The disc in claim 1 in which said sheet is flexible plastic material.

4. The disc in claim 3 in which said sheet is mylar having a thickness between approximately 0.0075" and approximately 0.011".

5. The disc in claim 3 in which said sheet is Lexan having a thickness between approximately 0.0075" and approximately 0.011".

6. The disc in claim 3 in which said sheet has a plurality of spaced holes near its perimeter and said annular member has a plurality of correspondingly spaced pins each extending through one of said holes, respectively, to hold said sheet in place on said annular member.

7. The disc in claim 3 in which the peripheral region of said sheet is adhesively attached to said annular member.

8. The disc in claim 1 in which said sheet comprises a layer of paper.

9. The disc in claim 1 in which said sheet is cloth.

10. The disc in claim 6 in which said annular member has a plurality of pins located adjacent the inner perimeter thereof and extending generally parallel to the axis of said annular member, and said thin sheet has a corresponding plurality of apertures to fit over and engage said pins.

11. A disc of claim 10 in which said pins are deformed to hold said thin sheet securely in place thereon.

12. The disc in claim 11 in which said pins are deformed at their outer ends to form heads thereon of larger cross-sectional dimension than the holes in said thin sheet to retain said sheet in place on said annular member.

13. The disc of claim 2 in which said thin sheet comprises a base for graphic representations.

14. The disc of claim 13 comprising a layer of photosensitive material on one surface of said sheet.

15. The disc of claim 14 in which said layer of photosensitive material is covered with a peelable layer of opaque material.

16. The disc of claim 15 comprising a second layer of opaque material on the other surface of said sheet.

17. The disc of claim 2 comprising a reflective layer on one surface thereof.

18. The disc of claim 2 in which said thin sheet comprises a Fresnel lens.

19. The disc of claim 1 comprising balanced weighting means near the outer perimeter of said annular member.

20. A flying disc comprising:

a central sheet comprising a perimeter in substantially one plane;

a separate annular section attached to and extending outwardly beyond said perimeter and curved in one direction from said plane, whereby said sheet and said annular section combine to define a dish-shaped structure having a concave side and a convex side, said annular section comprising a rounded cross-section that is thickest at an annular position between the edge of said annular section and said perimeter of said sheet; and a plurality of spoilers on said convex side, each of said spoilers extending in a direction comprising a radial component.

21. The disc of claim 20 in which said spoilers extend radially with respect to the axis of said disc.

22. The disc of claim 20 in which said spoilers have a generally rectangular cross-section.

23. The disc of claim 20 in which said spoilers have an undulating exposed surface.

24. The disc of claim 20 in which said spoilers have a serrate cross-section.

25. The disc of claim 20 in which said spoilers extend over the perimeter of said central sheet.

26. The disc of claim 20 in which said central sheet is a web of thin material having greater puncture resistance for a given thickness than the material of said annular section.

27. The disc of claim 26 in which said web is a laminated disc comprising a layer of polyester and a layer of polyethylene, said annular section is an annular ring of molded polyethylene, and the peripheral region of said polyester layer is adhesively attached to an inner annular surface portion of said annular ring.

28. The method of attaching a peripheral region of a polyester disc to an inner peripheral region of a polyethylene ring comprising the steps of:

coating said peripheral region of said disc with an adhesive in liquid form comprising neoprene and 1, 1, 1-trichloroethane solvent;

oxidizing said inner peripheral region of said ring;

coating the resultant oxidized region with said adhesive;

allowing said adhesive on said disc and said ring to dry from approximately fifteen minutes to three hours; and pressing the adhesive-coated region of said disc against the adhesive-coated region of said ring with a pressure of between approximately 250 and 1000 pounds per square inch.

29. The method of claim 28 comprising stretching said inner peripheral region of said ring and the juxtaposed annular portion of said disc over a frusto-conical surface having an included angle of between approximately 150° and 180° with said ring between said frusto-conical surface and said disc while applying said pressure.

30. The disc of claim 20 in which said spoilers are defined by grooves in the surface of said convex side.

31. The disc of claim 30 in which said grooves extend radially.

32. The disc of claim 20 in which said spoilers comprise ridges raised above the adjacent surface of said convex side.

33. The disc of claim 27 in which at least one of said layers is transparent.

34. The disc of claim 20 comprising a snap-on outer ring removably attached to the outer perimeter of said dish-shaped structure.

35. The disc of claim 24 in which said snap-on outer ring has a ridged inwardly facing surface and the outer perimeter of said dish-shaped structure has a ridged surface that interlocks with the ridged inwardly facing surface of said ring.

36. The disc of claim 33 in which said ring is curved to fit around and substantially enclose the outer perimeter of said dish-shaped structure.

37. The disc of claim 33 in which said ring is transparent and comprises light-emitting means.

38. The disc of claim 20 comprising at least one removable ring fitted into said annular member to be held in place therein.

39. The disc of claim 38 in which said removable ring comprises a metal ring within a plastic cover.

40. The disc of claim 38 comprising a nested plurality of removable rings, the outermost of said nested plurality being fitted into the inwardly facing surface of said annular member to the held thereby.

41. The disc of claim 20 comprising a ring having a specific gravity such that the specific gravity of the entire disc is less than that of water.

42. The disc of claim 20 comprising an annular ring coated with adhesive on both radial surfaces and adherently joined by such adhesive to the perimeter of said central sheet and the inner perimeter of said annular section.

* * * * *